US006112385A

United States Patent [19]

Fleissner et al.

[11] Patent Number: 6,112,385

[45] Date of Patent: Sep. 5, 2000

[54] PROCESS FOR MANUFACTURING A NON-WOVEN FABRIC BY HYDRODYNAMIC NEEDLING, AND PRODUCT OF SAID MANUFACTURING PROCESS

[75] Inventors: Gerold Fleissner, Zug, Switzerland; Alfred Watzl, Rodermark, Germany

[73] Assignee: Fleissner GmbH & Co., Maschinenfabrik, Egelsbach, Germany

[21] Appl. No.: 08/983,482

[22] PCT Filed: Jul. 17, 1996

[86] PCT No.: PCT/EP96/03130

§ 371 Date: Jan. 22, 1998

§ 102(e) Date: Jan. 22, 1998

[87] PCT Pub. No.: WO97/44512

PCT Pub. Date: Nov. 27, 1997

[30] Foreign Application Priority Data

May 22, 1996 [DE] Germany ..... 196 20 503

[51] Int. Cl.[7] ..... D04H 1/46

[52] U.S. Cl. ..... 28/104; 28/167; 442/408

[58] Field of Search ..... 28/104, 105, 103, 28/167, 165; 442/408, 402, 351; 428/903, 131; 34/381, 389, 444, 459; 8/147, 149.1, 149.2, 149.3

[56] References Cited

U.S. PATENT DOCUMENTS 5,650,219 7/1997 Honeycutt ..... 442/408

5,885,907 3/1999 Honeycutt et al. ..... 442/402

FOREIGN PATENT DOCUMENTS 671496 9/1995 European Pat. Off. .

*Primary Examiner*—Amy Vanatta

*Attorney, Agent, or Firm*—Antonelli, Terry, Stout & Kraus, LLP

[57] ABSTRACT

It is known to make a nonwoven from polyvinyl alcohol fibers. The special advantage of these PVA fibers is their ability to dissolve in water. The fleece is therefore mechanically needled for compaction. The invention describes a method that allows hydrodynamic needling as well. Special parameters for further treatment during water needling and during subsequent drying characterize the additional features of the invention.

16 Claims, No Drawings

PROCESS FOR MANUFACTURING A NONWOVEN FABRIC BY HYDRODYNAMIC NEEDLING, AND PRODUCT OF SAID MANUFACTURING PROCESS

BACKGROUND OF THE INVENTION

In the journal ITB Nonwovens, Industrial Textiles, 4/95, pages 20–25, "Degradables or the Recycling Economy for Disposables," or in the journal Chemical Fibers International, Vol. 46, April 1996, page 102, "A New Water-Soluble PVA Fiber for Nonwovens Application," a special chemical fiber is described made from a hydrophilic synthetic polymer. In addition to other important properties, it has the special ability to dissolve in water at certain temperatures without leaving a residue. The fiber consists of a polyvinyl alcohol and can be processed by weaving or by nonwoven technology to form a sheet material from which any desired article of clothing or the like can be produced. These sheets made of PVA fibers however are used especially in hygienic products because after being used during surgery in a hospital for example, they can be disposed of easily and rapidly if contaminated with blood and the like by dissolving them in hot water.

It is known that these PVA fibers can be processed by means of a card or aerodynamically to form a nonwoven. To lend them sufficient strength, these fleeces are compacted by mechanical needling technology and then processed to produce the desired articles of clothing. It has been found that fleeces with these fibers that have been compacted by mechanical needling technology can be produced at rates that are too low for industry. In addition, when mechanical needling is used, there is a risk of holes being formed, which is disadvantageous for the desired impermeability of the hygienic articles to water.

The goal of the invention is to develop a method by which the nonwoven manufactured as usual from these PVA fibers can be compacted continuously at a higher rate than by the mechanical method, and thus a product can be produced that is uniformly compacted and is essentially impermeable to fluid.

DISCLOSURE OF THE INVENTION

It is known to use hydrodynamic needling alone to produce a compacted endless fleece product. The fleece web coming from a fleece-laying machine such as a card or together with a cross-layer is subjected immediately thereafter to needling water jets to compact the fleece product. Then the wet fleece must be dried. The idea of the invention is to process a nonwoven by this method, said nonwoven consisting at least partially of PVA fibers. Initially it would appear impossible to use this water needling method alone as a compaction method for such a chemical fiber, since the fibers come in contact with water for a prolonged period of time during needling and therefore there is a risk of their dissolving. This danger exists, if not during needling itself, then at least during the drying of the wet fleece product immediately afterward, since drying is not possible without heat.

It has now been found according to the invention that it is nevertheless possible with several special parameters to compact a fleece product made of these fibers using the hydrodynamic method. Thus for example it is advantageous if the previously moistened nonwoven is subjected once on both sides to the water jets and by several water jets in sequence in each case with the energy of the jets of the next nozzle beam always being higher, for example from 50 bar to 120 bar on the first side and from 120 bar to 160 bar on the second side. The last needling on each side should be performed at about 80 bar and performed with a larger number of water jets distributed across the width of the nonwoven in order to produce a uniformly smooth surface. Under these conditions, a fleece weight of 40 to 150 g/m$^2$ can be compacted. The transport speed of the nonwoven during compaction is 70 m/min or more. The fleece-processing rate depends only on the possible fleece-laying rate. The production rate is adjusted to the respective fleece weight, but it is always lower at higher weights.

It is important how the drying parameters are defined. Initially the needled fleece must be dewatered mechanically before it is dried, by squeezing or by suction for example, in order to achieve a level of moisture that is not more than 100%. Then the fleece must be dried by drying air which is not heated to a temperature greater than 120° C. It is especially advantageous for the drying and the ventilation to be performed at the same time, in this case on a rotating screen drum with internal suction, and to increase the air speed in the fleece by a high fan rpm, up to 4 m/second. Various tests have shown that with this method there is no damage to the PVA fibers. Both during drying and also during the hot final processing that follows, there were no visible disadvantages like the brown spots that usually occur otherwise. Basically, drying is also possible using a belt dryer, with ventilation also being produced, or with an IR dryer, etc.

If the fleece is also to be given impregnation such as foam or liquid impregnation that makes it water-repellent, it is advantageous to perform this step after a first drying down to 30% moisture content unless impregnation takes place wet-in-wet. Then after the first drying, the second drying stage should be performed exactly like the first at a temperature of up to 120° C. and the fleece dried completely. It is also possible to perform impregnation only after drying for example down to 5% moisture content. Following complete drying of the needled fleece, it is no problem to crosslink the fleece at temperatures up to 210° C.

It is known that a fleece made of these PVA fibers can be provided with an additional layer of pulp or paper in order to increase the water-repellent property of the nonwoven. Foam impregnation, liquid impregnation, and also advantageously in the method according to the invention, application of a layer of this kind in pulp form or as tissue paper, can be used, and then bonding the layer to the needled fleece, with said layer being laid down on the fleece prior to the second needling for needling on the back side simultaneously with the fleece, said layer being bonded with the fleece during the needling that then takes place.

The method according to the invention produces a novel product. The subject of the application also extends to a fleece product made of PVA fibers that is compacted by water needling on both sides for example and finally is dried as well.

We claim:

1. Method for producing an endless fleece product, comprising laying down a fleece web by a fleece-laying machine, said fleece web comprising PVA (polyvinyl alcohol) fibers; striking the surface of the fleece with needling water jets to compact the fleece; mechanically partially dewatering the needled fleece; and then drying the fleece with air passing through the fleece, the air passing through the fleece having a through-flow speed of more than 2 to 4 m/sec and a temperature up to 120° C.

2. Method according to claim 1, further comprising, after mechanically partially dewatering the water-needled fleece, subjecting the fleece to a second drying stage comprising passing air through the fleece at a maximum temperature of 120° C.

3. Method according to claim 1, further comprising briefly heating the dry fleece to a temperature of about 210° C. for curing.

4. Method according to claim 1, further comprising impregnating the fleece with a finishing agent that makes fibers of the fleece water-repellent.

5. Method according to claim 1, characterized in that the step of striking the surface of the fleece with needling water jets comprises striking the fleece with needling water jets on both sides of the fleece.

6. Method according to claim 1, characterized in that the fleece composed of PVA fibers is laid down during water-needling on a belt supporting the fleece with a free surface of 18 to 25% and/or 80 to 120 mesh (wires per inch) with single or multiple binding.

7. Method according to claim 1, characterized in that the needling of the fleece is performed by several nozzle beams in succession with slightly increasing water pressure each time.

8. Method according to claim 5, characterized in that the step of striking the surface of the fleece with needling water jets comprises striking a first side of the fleece with several nozzle beams in succession with slightly increasing water pressure each time and then striking a second side of the fleece with several nozzle beams in succession and at water pressures higher than those used on the first side and that increase slightly.

9. Method according to claim 8, further comprising striking at least one side of the fleece with needling water jets from an additional nozzle beam charged with reduced water pressure and a higher hole density than the previous nozzle beams.

10. Method according to claim 1, further comprising coating one side of the fleece with pulp or paper weighing about 15 g/m$^2$ and conducting a second needling for joining this coating with the fleece that has already been needled on one side.

11. Method according to claim 3, characterized in that the step of briefly heating the dry fleece to a temperature of about 210° for curing is carried out from 20–30 seconds.

12. Method according to claim 7, characterized in that the needling of the fleece is performed by nozzle beams at slightly increasing water pressures of about 50, 80 and about 120 bars.

13. Method according to claim 8, characterized in that the needling of the first side of the fleece is performed by nozzle beams at slightly increasing water pressures of 50, 80 and about 120 bars, and the needling of the second side of the fleece is performed by nozzle beams at slightly increasing water pressures of 120, 140, and 160 bars.

14. Method according to claim 9, characterized in that the reduced water pressure is about 80 bars.

15. Fleece product produced by the method according to claim 1.

16. Fleece product formed at least partially of PVA fibers compacted by water needling on both sides and then dried with air passing through the fleece.

* * * * *